US006659032B1

(12) United States Patent
Simon

(10) Patent No.: US 6,659,032 B1
(45) Date of Patent: Dec. 9, 2003

(54) STABILIZER FOR USE ON A CANOE-LIKE BOAT

(76) Inventor: Gerald M. Simon, 4530 Esch La., Madison, WI (US) 53704

( * ) Notice: Subject to any disclaimer, the term of this patent is extended or adjusted under 35 U.S.C. 154(b) by 17 days.

(21) Appl. No.: 10/272,260

(22) Filed: Oct. 17, 2002

(51) Int. Cl.[7] ..... B63B 43/14
(52) U.S. Cl. ..... 114/123
(58) Field of Search ..... 114/61.1, 123, 114/357, 347, 351, 352

(56) References Cited

U.S. PATENT DOCUMENTS 3,537,417 A * 11/1970 Beckner ..... 114/123
D271,750 S 12/1983 Karosi
4,807,551 A 2/1989 Ace
4,838,196 A 6/1989 Ingram
4,862,818 A 9/1989 Sullivan
5,324,218 A 6/1994 Rijnders

* cited by examiner

*Primary Examiner*—Stephen Avila
(74) *Attorney, Agent, or Firm*—Donald R. Schoonover

(57) ABSTRACT

A stabilizer is releasably attached to a canoe-like boat and includes two floats that are located outside the periphery of the boat. The floats are attached to bars, and a lock mechanism attaches the bars to the boat. The bars are releasably attached together.

3 Claims, 2 Drawing Sheets

STABILIZER FOR USE ON A CANOE-LIKE BOAT

BACKGROUND OF THE INVENTION

1. Field of the Invention

The present invention relates to the general art of water vehicles, and to the particular field of accessories for water vehicles.

2. Discussion of the Related art

Many people enjoy spending their leisure time in pursuit of outdoor recreational activities. These activities include athletics, hunting, fishing, camping, hiking and boating. Many people who participate in these activities do so infrequently. This group of people may or may not have all of the equipment or expertise that they require in order to fully and safely enjoy themselves. Other enthusiasts are found with a full complement of equipment and materials needed to safely derive the greatest amount of pleasure from participation in their chosen activity. This latter group generally has taken training classes or has been coached in the activity's finer points.

Boating is a popular outdoor activity. By itself, boating can bring one into a close relationship with nature as a canoeist or kayaker glides nearly silently through a marsh or along a river. In combination with camping, hiking, hunting or fishing, the use of a boat can enhance outdoor experiences. The use of a boat requires that a person follow certain prescribed safety guidelines including the use of life jackets and the following of boat capacity limitations.

Paddling a canoe has its own set of usage guidelines as well as tho se that pertain to all types of boats. In particular, the style of some canoes makes them slightly unstable as compared to a rowboat or Jon boats or the like. This is especially true of canoes with narrow hulls such as those that might be used on a river rather than on a lake for example.

Therefore, it is not uncommon for even experienced canoeists to be involved in an accidental tipping of a canoe.

Therefore, there is a need for a stabilizer mechanism for use on a boat, and which will increase the safety of the boat, for both experienced and inexperienced boaters.

Many canoes or the like are carried over great distances and are assembled only when used and then disassembled after use. This assembly and disassembly may take place under difficult conditions, such as may occur in the woods or the like. The more parts that must be assembled or disassembled, the greater the likelihood that the parts can become lost or will not be properly assembled. If there are too many parts, the canoeist may simply omit part of the boat. If a safety system falls into this category, the safety system may be omitted, and the safety features associated therewith will be lost.

Therefore, there is a need for a safety mechanism for use on a boat which is easily assembled and disassembled.

Still further, if an added feature increases the cost of a boat, it may be omitted. As discussed above, if the added feature is a safety feature, there may be a temptation to omit the feature in an effort to save money. This may be especially tempting to an experienced canoeist. However, it is desirable to encourage all to take full advantage of any and all safety features that are available to a canoeist.

Therefore, there is a need for a stabilizer mechanism for use on a boat which is sturdy and reliable yet which is also inexpensive.

Since many canoeists travel on waters that can become rough at a moment's notice and without warning, it is especially desirable to have a safety feature that will prevent tipping of the boat. While an experienced canoeist may be able to right a boat under most conditions, an inexperienced canoeist may lose the boat and capsize. Again, while an experienced canoeist may be able to handle a capsized condition, an inexperienced canoeist may find himself or herself in trouble if the canoe capsizes. Even experienced canoeists may find themselves in trouble if a canoe capsizes under certain conditions.

Therefore, there is a specific need for a stabilizer mechanism for use on a boat which will prevent the boat from capsizing.

PRINCIPAL OBJECTS OF THE INVENTION

It is a main object of the present invention to provide a stabilizer mechanism for use on a boat.

It is another object of the present invention to provide a stabilizer mechanism for use on a boat which increases safety of the sport of boating.

It is another object of the present invention to provide a stabilizer mechanism for use on a boat which increases the safety of boating for both experienced and inexperienced boaters.

It is another object of the present invention to provide a stabilizer mechanism for use on a boat which inhibits capsizing of the boat.

It is another object of the present invention to provide a stabilizer mechanism for use on a boat which is easily attached to the boat, and which is also easily removed from the boat.

It is another object of the present invention to provide a stabilizer mechanism for use on a boat which is sturdy yet which is also inexpensive.

SUMMARY OF THE INVENTION

These, and other, objects are achieved by a stabilizer for a canoe-like boat which comprises a canoe-like boat having a forward end, an aft end, a longitudinal axis extending between the forward end and the aft end of the boat, a first side connecting the forward end to the aft end, a second side connecting the forward end to the aft end, a transverse axis extending between the first side and the second side, a periphery defined by the first side of the boat and the second side of the boat and the forward end of the boat and the aft end of the boat, a top rail extending around the periphery of the boat, an outside location located outside the periphery of the boat, and an inside location located inside the periphery of the boat. A boat stabilizer system includes two stabilizer unit bodies that extend in the direction of the transverse axis of the boat when in use, a releasable joint mechanism connecting the stabilizer unit bodies together when in use, a releasable lock mechanism releasably locking each stabilizer unit body to the top rail of the boat when in use, and a float on each stabilizer unit body and located to be outside the periphery of the boat when in use.

The stabilizer mechanism extends outside the periphery of the boat and thus tends to lower the center of gravity of the boat making that boat more stable. The floats on the distal ends of the mechanism also tend to keep the boat from capsizing by engaging the water before the boat capsizes. The mechanism is easily set up and attached to the boat at any desired location on the boat, and is also easily knocked down. Once disassembled, the mechanism can be easily and conveniently stored. The mechanism is formed of sturdy, yet inexpensive elements so it will be inexpensive to purchase and maintain and/or replace. Thus, the mechanism will be readily available to anyone who wishes to use such a mechanism.

BRIEF DESCRIPTION OF THE DRAWING FIGURES

DETAILED DESCRIPTION OF THE PREFERRED EMBODIMENT

Figure 1:
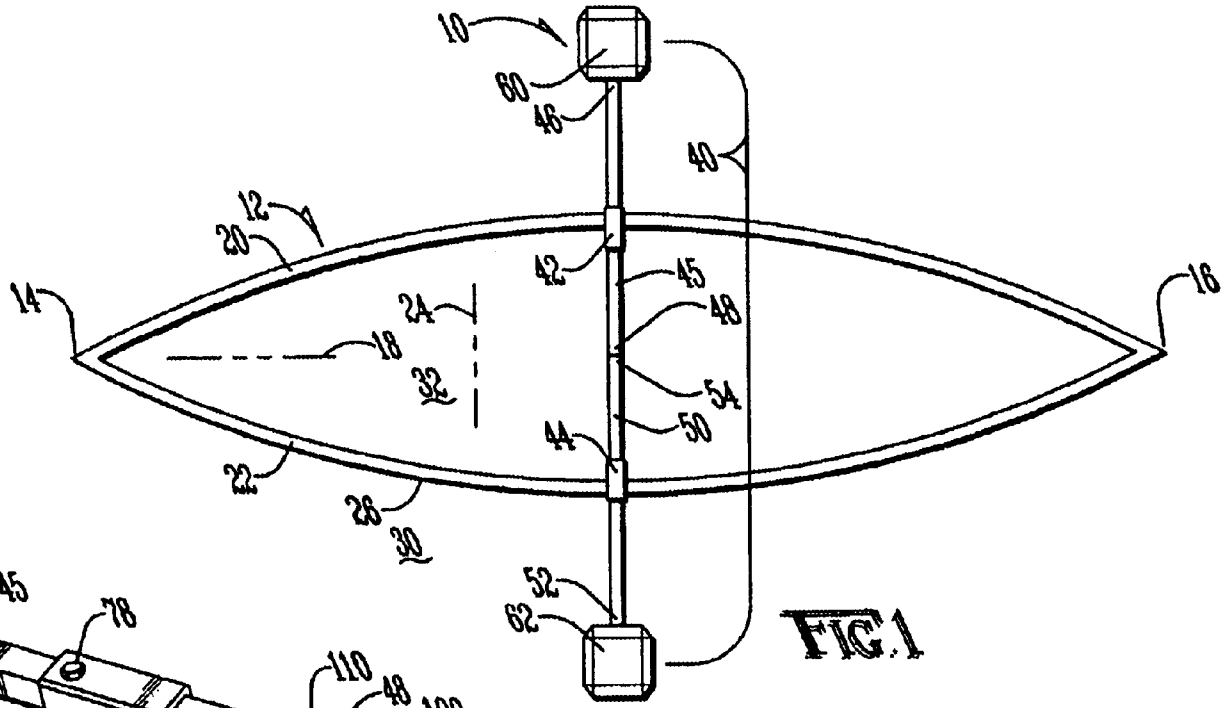
FIG. 1 is a top plan view of a canoe-like boat that has the stabilizer of the present invention attached thereto.

Other objects, features and advantages of the invention will become apparent from a consideration of the following detailed description and the accompanying drawings.

As shown in the figures the present invention is embodied in a stabilizer 10 for a canoe-like boat 12. The stabilizer 10 prevents the canoe 12 from capsizing by lowering the center of gravity of the boat 12 in the manner of a tightrope walker carrying a balance beam and also engages the water during a tipping motion, once that motion begins, to prevent the boat 12 from capsizing. Stabilizer 10 is used on canoe-like boat 12 which has a forward end 14, an aft end 16, and a longitudinal axis 18 extending between the forward end 14 and the aft end 16 of the boat 12. A first side 20 connects the forward end 14 to the aft end 16, a second side 22 connects the forward end 14 to the aft end 16, and a transverse axis 24 extends between the first side 20 and the second side 22. A periphery 26 is defined by the first side 20 of the boat 12 and the second side 22 of the boat 12 and the forward end 14 of the boat 12 and the aft end 16 of the boat 12. A top rail 28 extends around the periphery 26 of the boat 12, and defines an outside location 30 located outside the periphery 26 of the boat 12 and an inside location 32 located inside the periphery 26 of the boat 12.

Figure 2:
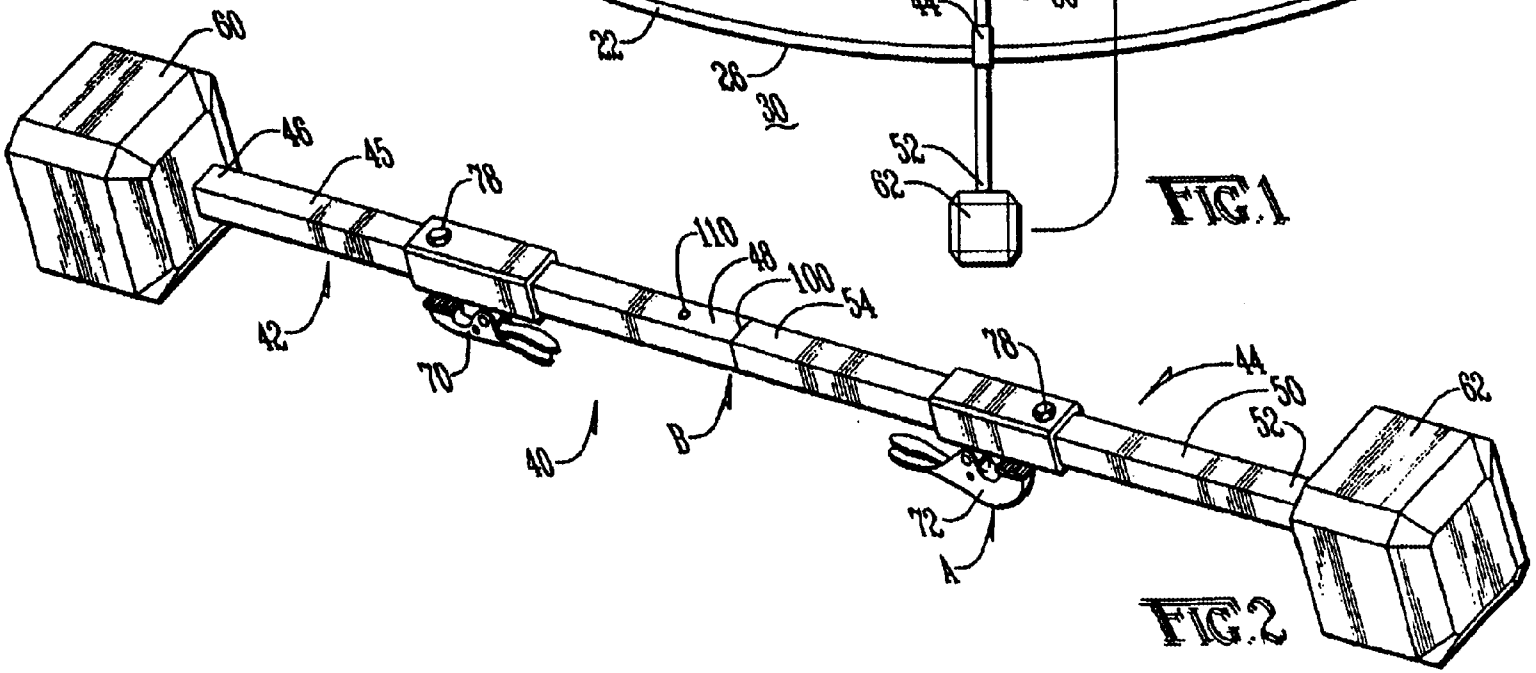
FIG. 2 is a perspective view of the stabilizer embodying the present invention.
Figure 3:
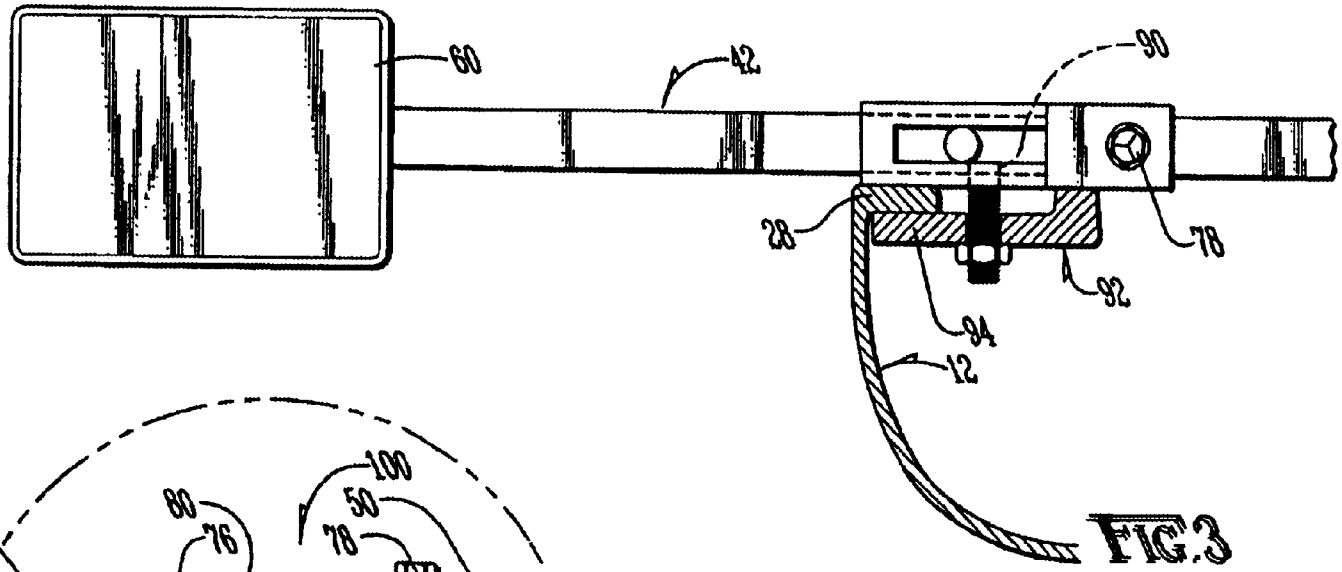
FIG. 3 is an elevational view of one unit of the stabilizer embodying the present invention in place on a canoe-like boat.
Figure 4:
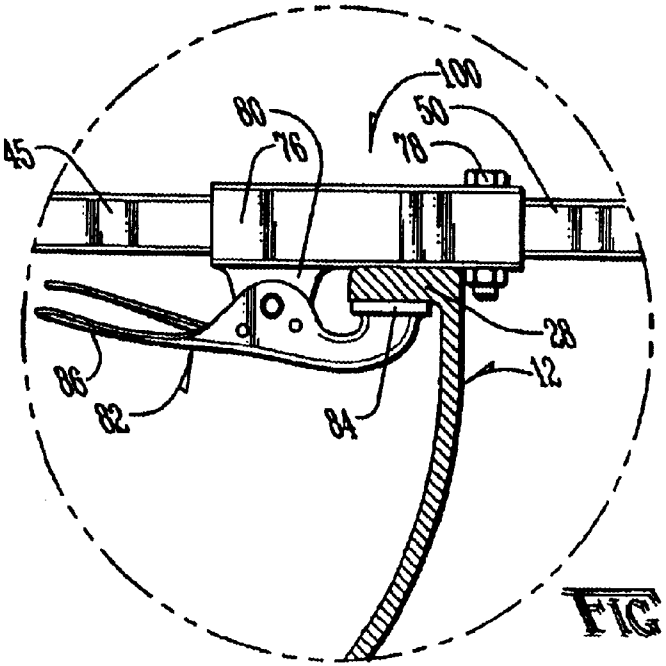
FIG. 4 is a detailed view of Detail A of FIG. 2.

A boat stabilizer system 40 includes a first stabilizer unit 42 and a second stabilizer unit 44. As shown in FIGS. 2, 3 and 4, the first stabilizer unit 42 has a body 45 with a distal end 46 and a proximal end 48. The distal end 46 of the body 45 of the first stabilizer unit 42 is located outside the periphery 26 of the boat 12 when the first stabilizer unit 42 is in use and the proximal end 48 of the body 45 of the first stabilizer unit 42 is located inside the periphery 26 of the boat 12 when the first stabilizer unit 42 is in use. Second stabilizer unit 44 has a body 50 with a distal end 52 and a proximal end 54. Distal end 52 of the body 50 of the second stabilizer unit 44 is located outside the periphery 26 of the boat 12 when the second stabilizer unit 44 is in use and proximal end 54 of the body 50 of the second unit 44 is located inside the periphery 26 of the boat 12 when the second stabilizer unit 44 is in use. As shown, the proximal end 48 of the body 45 of the first stabilizer unit 42 is located adjacent to the proximal end 54 of the body 50 of the second stabilizer unit 44 when the first and second stabilizer units 42, 44 are in use.

A first float 60 is fixedly mounted on distal end 46 of the body 45 of the first stabilizer unit 42 and a second float 62 is fixedly mounted on distal end 52 of the body 50 of the second stabilizer unit 44. Floats 60 and 62 can be formed of styrofoam-like material or the like or any suitable material that is highly floatable.

The stabilizing system 40 of the present invention is releasably attached to the boat 12 so it can be easily assembled and set up and easily disassembled. To this end, a first lock unit 70 is on body 45 of the first stabilizer unit 42 near proximal end 48 of the body 45 of the first stabilizer unit 42, and a second lock unit 72 is on the body 50 of the second stabilizer unit 44 near proximal end 54 of the body 50 of the second stabilizer unit 44. The lock units 70, 72 can be either of two forms, with one form being shown in FIGS. 2 and 4 and a second form being shown in FIG. 3. Each lock unit of the first lock unit 70 and the second lock unit 72 includes a sleeve 76 on the body 45, 50 of the stabilizer unit 42, 44 associated therewith, a fastener 78 attaching the sleeve 76 to the body 45, 50 of the stabilizer unit 42, 44 associated therewith, a mounting element 80 attached to the sleeve 76, and a clamp element 82 attached to the mounting element 80. The clamp element 82 has a distal end 84 and a proximal end 86. The distal end 84 of the clamp element 82 engages the top rail 28 of the boat 12 when the stabilizer unit 42, 44 associated therewith is in use. The clamp element 82 is movably attached to the mounting element 80 to move between a clamping position shown in FIG. 4 and FIG. 3 in solid lines engaging the top rail 28 and a released position spaced from the top rail 28.

An over-center type lock is shown in FIG. 4 and a clamp-type lock is shown in FIG. 3. The over-center type lock is known in the art and thus will not be discussed, and the clamp-type lock includes a threaded bore 90 defined in the sleeve 76 as well as a threaded fastener 92 mounted on a clamp plate 94. Threaded movement of fastener 92 draws the clamp plate 94 toward the top rail 28 of the boat 12 to fix the stabilizer unit 42, 44 to the boat 12, while retrograde movement of the threaded fastener 92 will release the clamp plate 94 from the top rail 28 of the boat 12.

Figure 5:
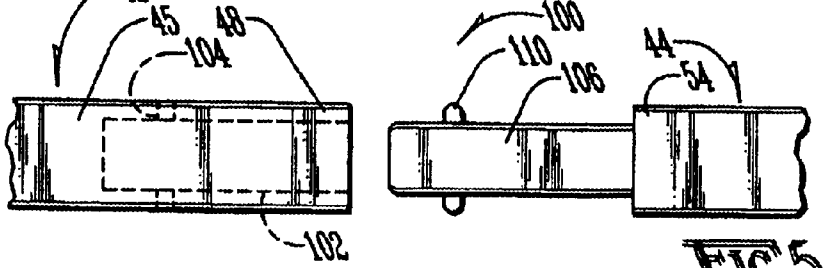
FIG. 5 is a detailed view of Detail B of FIG. 2.

The stabilizer units 42, 44 are easily assembled and disassembled and once assembled are very secure. A connecting joint 100 effects this assembly and disassembly. Connecting joint 100 is shown in FIGS. 2 and 5 and includes a blind-ended bore 102 defined in body 45 of the first stabilizer unit 42. Bore 102 extends from proximal end 48 of the body 45 of first stabilizer unit 42 toward the distal end 46 of the body 45 of the first stabilizer unit 42. A locking hole 104 is defined through the body 45 of the first stabilizer unit 42 adjacent to blind-ended bore 102. A projection 106 is on proximal end 54 of the body 50 of second stabilizer unit 44 and extends outwardly from the proximal end 54 of the body 50 of the second stabilizer unit 44. Projection 106 is sized to be releasably accommodated in blind-ended bore 102 defined in the body 45 of the first stabilizer unit 42. A spring-biased locking tube 110 is located on projection 106 of the connecting joint 100. The spring-biased tube 110 is indicated in FIGS. 2 and 5 as located to be accommodated in locking hole 104 defined through the body 45 of the first stabilizer unit 42 when the projection 106 on the second stabilizer unit 44 is received in the blind-ended bore 102 of the first stabilizer unit 42. The spring-biased tube 110 being larger than the locking hole 104 and being biased to be seated in the locking hole 104 when the projection 106 of the connecting joint 100 is received in the blind-ended bore 102 of the connecting joint 100.

As shown in FIG. 1, when the stabilizer system 40 embodying the present invention is in use, the stabilizer system 40 extends across the boat 12 in the direction of the transverse axis 24 of the boat 12, the lock unit 70 of the first stabilizer unit 42 releasably engages the top rail 28 of the boat 12, the lock unit 72 of the second stabilizer unit 44 releasably engages the top rail 28 of the boat 12, the projection 106 of the connecting joint 100 is received in the blind-ended bore 102 of the connecting joint 100, the float 60 on the first stabilizer unit 42 is located outside the periphery 26 of the boat 12, and the float 62 on the second stabilizer unit 44 is located outside the periphery 26 of the boat 12. The user, sits inside the boat 12 and the stabilizer system 40 of the present invention prevents the boat 12 from capsizing as discussed above.

It is understood that while certain forms of the present invention have been illustrated and described herein, it is not to be limited to the specific forms or arrangements of parts described and shown.

What is claimed and desired to be covered by Letters Patent is:

1. A stabilizer for a canoe-like boat comprising:

a) a canoe-like boat having
(1) a forward end,
(2) an aft end,
(3) a longitudinal axis extending between the forward end and the aft end of the boat,
(4) a first side connecting the forward end to the aft end,
(5) a second side connecting the forward end to the aft end,
(6) a transverse axis extending between the first side and the second side,
(7) a periphery defined by the first side of the boat and the second side of the boat and the forward end of the boat and the aft end of the boat,
(8) a top rail extending around the periphery of the boat,
(9) an outside location located outside the periphery of the boat, and
(10) an inside location located inside the periphery of the boat;

b) a boat stabilizer system which includes
(1) a first stabilizer unit having a body with a distal end and a proximal end, the distal end of the body of the first stabilizer unit being located outside the periphery of the boat when the first stabilizer unit is in use and the proximal end of the body of the first unit being located inside the periphery of the boat when the first stabilizer unit is in use,
(2) a second stabilizer unit having a body with a distal end and a proximal end, the distal end of the body of the second stabilizer unit being located outside the periphery of the boat when the second stabilizer unit is in use and the proximal end of the body of the second unit being located inside the periphery of the boat when the second stabilizer unit is in use,
(3) the proximal end of the body of the first stabilizer unit being located adjacent to the proximal end of the body of the second stabilizer unit when the first and second stabilizer units are in use,
(4) a first float fixedly mounted on the distal end of the body of the first stabilizer unit,
(5) a second float fixedly mounted on the distal end of the body of the second stabilizer unit,
(6) a first lock unit on the body of the first stabilizer unit near the proximal end of the body of the first stabilizer unit,
(7) a second lock unit on the body of the second stabilizer unit near the proximal end of the body of the second stabilizer unit,
(8) each lock unit of the first lock unit and the second lock unit including
(A) a sleeve on the body of the stabilizer unit associated therewith,
(B) a fastener attaching the sleeve to the body of the stabilizer unit associated therewith,
(C) a mounting element attached to the sleeve,
(D) a clamp element attached to the mounting element and having a distal end and a proximal end, the distal end of the clamp element engaging the top rail of the boat when the stabilizer unit associated therewith is in use, the clamp element being movably attached to the mounting element to move between a clamping position engaging the top rail and a released position spaced from the top rail, and
(9) a connecting joint which includes
(A) a blind-ended bore defined in the body of the first stabilizer unit and which extends from the proximal end of the body of the first stabilizer unit toward the distal end of the body of the first stabilizer unit,
(B) a locking hole defined through the body of the first stabilizer unit adjacent to the blind-ended bore defined in the body of the first stabilizer unit,
(C) a projection on the proximal end of the body of the second stabilizer unit and which extends outwardly from the proximal end of the body of the second stabilizer unit, the projection being sized to be releasably accommodated in the blind-ended bore defined in the body of the first stabilizer unit, and
(D) a spring-biased locking tube on the projection of the connecting joint, the spring-biased tube being located to be accommodated in the locking hole defined through the body of the first stabilizer unit when the projection on the second stabilizer unit is received in the blind-ended bore of the first stabilizer unit, the spring-biased tube being larger than the locking hole and being biased to be seated in the locking hole when the projection of the connecting joint is received in the blind-ended bore of the locking joint; and c) the stabilizer system extending across the boat in the direction of the transverse axis of the boat, the lock unit of the first stabilizer unit releasably engaging the top rail of the boat, the lock unit of the second stabilizer unit releasably engaging the top rail of the boat, the projection of the connecting joint being received in the blind-ended bore of the connecting joint, the. float on the first stabilizer unit being located outside the periphery of the boat and the float on the second stabilizer unit being located outside the periphery of the boat when the stabilizer system is in use.

2. The stabilizer as described in claim 1 wherein the locking mechanism includes a threaded bore defined in the sleeve and a threaded. fastener threadably received in the threaded bore.

3. The stabilizer as described in claim 1 wherein the locking mechanism includes an over-center lock.

* * * * *